US005510676A

United States Patent [19]

Cottaar et al.

[11] Patent Number: 5,510,676

[45] Date of Patent: Apr. 23, 1996

[54] HIGH-PRESSURE SODIUM LAMP

[75] Inventors: Eduardus J. E. Cottaar, Santa Rosa, Calif.; Peter J. Vrugt, Turnhout, Belgium

[73] Assignee: U.S. Philips Corporation, New York, N.Y.

[21] Appl. No.: 415,781

[22] Filed: Apr. 3, 1995

Related U.S. Application Data

[63] Continuation of Ser. No. 7,216, Jan. 22, 1993, abandoned.

[30] Foreign Application Priority Data

Mar. 16, 1992 [EP] European Pat. Off. ..... 92200739

[51] Int. Cl.[6] ..... H01J 61/20

[52] U.S. Cl. ..... 313/639; 313/25; 313/637

[58] Field of Search ..... 313/639, 25, 637

[56] References Cited

U.S. PATENT DOCUMENTS

| | | | |
|---|---|---|---|
| 4,755,721 | 7/1988 | Okada et al. | 313/639 |
| 4,855,643 | 8/1989 | White . | |
| 5,015,913 | 5/1991 | Pfaue | 313/623 |
| 5,142,188 | 8/1992 | Ravi et al. | 313/639 |

FOREIGN PATENT DOCUMENTS 3307197 9/1984 Germany .

OTHER PUBLICATIONS

Neues aus der Technik, No. 4, 15 Dec. 1989.

"The High Pressure Sodiumlamp", 1st impression, 1986, de Groot and van Vliet, pp. 165–169.

"White HPS lamps with a Color Temperature of 2700K", S. Carleto et al., J. of the IES, Winter 1991.

*Primary Examiner*—Sandra L. O'Shea
*Assistant Examiner*—Matthew J. Esserman
*Attorney, Agent, or Firm*—Brian J. Wieghaus

[57] ABSTRACT

A high pressure sodium lamp includes discharge vessel (20) which is enclosed with intervening space (1) by an outer bulb (10), which space contains a gas-fill with at least 70 mol. % nitrogen gas. Electrodes (30*a*, 30*b*) are positioned in the discharge vessel (20) and are each connected to a current supply conductor (40*a*, 40*b*) which issues from the discharge vessel (20) at a respective end (21*a*, 21*b*) thereof. The discharge vessel (20) has between the electrodes (30*a*, 30*b*) a central portion (22) with length L and volume V. The discharge vessel (20) contains an amalgam containing a weight $m_{Hg}$ of mercury and a weight $m_{Na}$ r. of sodium, whereby the following relations are fulfilled:

$$0.8 \leqq \frac{m_{Hg}}{\sqrt{V \times L}} \leqq 1.7$$

and $$0.05 \leqq \frac{m_{Na}}{m_{Hg}} \leqq 0.25$$

in which $m_{Hg}$ and $m_{Na}$ are expressed in mg, and L and V are expressed in cm and $cm^3$, respectively. This allows for a stable operation despite temperature fluctuations in the environment, while breakdown in the outer bulb (10) and damage caused by corrosion of current supply connectors (40*a*, 40*b*) is prevented.

4 Claims, 1 Drawing Sheet

HIGH-PRESSURE SODIUM LAMP

This is a continuation of application Ser. No. 08/007,216, filed on Jan. 22, 1993.

BACKGROUND OF THE INVENTION

The invention relates to a high-pressure sodium lamp provided with a ceramic discharge vessel which is enclosed with intervening space by an outer bulb, which space is provided with a gas filling, a pair of electrodes being arranged in the discharge vessel each connected to a current supply conductor issuing from the discharge vessel at a respective end, between which electrodes a central portion of the discharge vessel extends with a volume V and a length L, the discharge vessel being provided with a filling of an amalgam with a quantity $m_{Na}$ of sodium by weight and a quantity $m_{Hg}$ of mercury by weight.

Such a lamp is known from Neues aus der Technik, No. 4, 15 December 1989. By "ceramic discharge vessel" is meant a discharge vessel of a refractory material such as monocrystalline metal oxide, for example sapphire, polycrystalline metal oxide, for example translucent gastight aluminium oxide (PCA) or yttrium oxide, and crystalline non-oxidic material such as aluminum nitride. The gas filling in the space between the discharge vessel and the outer bulb contributes to the heat transport from the discharge vessel to the surroundings. This has the advantage that a small discharge vessel can be used, so that the light radiated by the lamp can be very well concentrated into a beam and a high system efficiency can be achieved. A gas filling, however, increases the influence of the ambient temperature on the temperature of the discharge vessel, and thus leads to greater variations in the arc voltage of the lamp in the case of temperature fluctuations in the surroundings. It is stated for the unsaturated lamp, in which the sodium and the mercury are fully evaporated during evaporation, that the vapor pressure and thus the arc voltage and other lamp characteristics remain substantially constant in the case of temperature fluctuations. The use of a gas filling is for this reason recommended for an unsaturated lamp in the above publication.

For outdoor use, it is required for the unsaturated lamp that the amalgam be fully evaporated during operation at comparatively low ambient temperatures. Because of the small quantity of amalgam, the unsaturated lamp requires high temperatures at the ends of the discharge vessel which to realize vapor pressures which correspond to those of a comparable saturated lamp. These high temperatures in unsaturated lamps with PCA discharge vessels have an additional advantage because they achieve a comparatively high aluminum vapor pressure. The comparatively high aluminum vapor pressure decelerates parasitic chemical reactions between wall material and sodium, by which it is prevented that the quantity of sodium, which is already small, is lost in this way. Metal lamp components such as lead-through elements, soldered connections between the electrodes and the lead-through elements, and portions of current supply conductors adjoining the ends of the discharge vessel are also strongly heated at the prevailing high temperatures. Although nitrogen is regarded as an inert gas in the cited publication, it was found that this gas attacks the said metal lamp components under the prevailing conditions in the known lamp, which leads on the one hand to brittleness and on the other hand to a volume increase of the attacked component. The volume increase of lead-through elements involves the risk of the discharge vessel cracking and starting to leak. The embrittlement of a soldered joint will reduce the strength thereof and may even lead to a connection being completely broken. In the case of an electrode fastened by means of a soldered joint, this leads to tilting of the electrode, which means the end of lamp life. A disadvantage of argon and other rare gases is that breakdown occurs therein under certain circumstances when an ignition voltage for starting the lamp is applied, which renders ignition difficult and adversely affects lamp life.

SUMMARY OF THE INVENTION

It is an object of the invention to provide a lamp of the kind mentioned in the opening paragraph in which at least breakdown as well as attack of metal lamp components is avoided and whose sensitivity to ambient temperature fluctuations is nevertheless small.

According to the invention, the lamp of the kind described in the opening paragraph is for this purpose characterized in that the gas in the space in the outer bulb comprises at least 70 mol. % nitrogen, and in that $m_{Hg}$, V and L satisfy the relation and in that it is true for the weight ratio between sodium and mercury in the amalgam that $$0.8 \leqq \frac{m_{Hg}}{\sqrt{V \times L}} \leqq 1.7, \text{ and}$$

$$0.05 \leqq \frac{m_{Na}}{m_{Hg}} \leqq 0.25,$$

in which $m_{Hg}$ and $m_{Na}$ are expressed in mg, L in cm, and V in $cm^3$.

The said quantity of nitrogen prevents breakdown irrespective of any rare gases present in the outer bulb.

As a result of the chosen quantities of ingredients, the lamp has a saturated filling of which a quantity of mercury remains in the liquid phase during operation, which quantity is at most of an order of magnitude comparable to that of the evaporated quantity of mercury, while only a small quantity of sodium evaporates. Owing to the filling chosen in this way, it is found that a stable lamp operation is possible which is highly insensitive to external temperature changes. The insensitivity of the lamp operation is based on the effect of "mercury exhaustion" which occurs during operation and which is described in "The High Pressure Sodium lamp, 1st impression, 1986, de Groot and van Vliet, pp. 165–169". This description, which incidentally provides no indications that this effect can be used for practical purposes and in which also no link is laid with the use of a gas filling in the space enclosed by the outer bulb, gives as a guideline that this effect occurs at an amalgam dose of between 3 and 50 $\mu g/mm^3$. The inventor has found that, if this effect is to be utilized in practice, the required mercury dose not only depends on the volume of the central portion of the discharge vessel, but also on the length thereof. With a mercury dose below the value resulting from the lower limit of 0.8 for the ratio $m_{Hg}/\sqrt{(V \times L)}$, the mercury vapor pressure during lamp operation is so low that the lamp carries an inadmissibly high current under normal conditions. If the mercury dose is in excess of the value resulting from the upper limit of 1.7 for the said ratio, the quantity of mercury remaining in the amalgam is too great in proportion to the quantity present in the vapor phase, which has the result that the mercury exhaustion required for a stable lamp operation does not occur. The sodium dose required is dependent on the mercury dose. A weight ratio of sodium to mercury below 0.05 or above 0.25 leads to a bad color rendering and a low luminous efficacy.

The presence of an excess filling is essential for the mercury exhaustion effect to occur. The temperatures prevailing at the ends, accordingly, are low in comparison with an unsaturated lamp. It was indeed found that a nitride layer is formed on some portions of the current supply conductors in the lamp according to the invention, but that a further corrosive attack does not take place after that, so that damage is avoided.

The quantity of sodium in the discharge vessel is much greater than in a comparable unsaturated lamp. This is not only because the total quantity of amalgam is greater, but also because of the greater weight ratio of sodium to mercury in the amalgam. Special measures for limiting the loss of sodium, such as are desirable in an unsaturated lamp, are there/ore unnecessary. The comparatively low temperatures in the lamp according to the invention as a result have no adverse effects, also when a discharge vessel of DCA is used.

In spite of the saturated filling of the lamp according to the invention, it has an advantage which it shares with the unsaturated lamp, i.e. that the lamp does not extinguish and ignite periodically at the end of its life.

It is noted that a lamp is known from "White HPS lamps with a Color Temperature of 2700 K, S. Carleton et at., J. of the IES, Winter 1991", in which the outer bulb is filled with nitrogen. Lamps of this kind, however, have a comparatively low luminous efficacy and are accordingly uneconomical for many applications. It is noted in the said publication that the use of a gas filling renders the lamps more sensitive to changes in ambient temperature.

Furthermore, DE-33 07 197 A1 discloses a high-pressure sodium lamp in which the discharge vessel is provided with a filling of which the quantity of mercury evaporated during operation is of the same order of magnitude as the quantity remaining in the liquid state, while only a small quantity of sodium evaporates. The lamp, however, has an evacuated outer bulb.

In a favorable embodiment, it is true for the weight ratio of sodium to mercury in the amalgam that:

$$0.10 \leqq \frac{m_{Na}}{m_{Hg}} \leqq 0.20$$

In this embodiment, the distance in the CIE chromaticity diagram between the color coordinates of the light radiated by the lamp and the Planckian locus is at most approximately 0.01.

BRIEF DESCRIPTION OF THE DRAWINGS

An embodiment of the lamp according to the invention will be explained in more detail with reference to the drawing, in which.

It is noted that the Figures are not drawn true to scale.

DETAILED DESCRIPTION OF THE PREFERRED EMBODIMENTS

Figure 1:
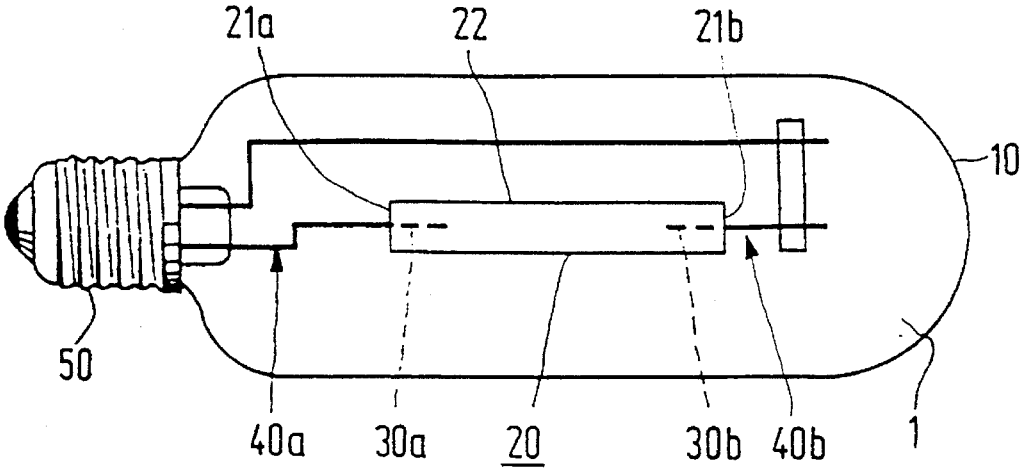
FIG. 1 is an elevation of a high-pressure sodium lamp according to the invention.
Figure 2:
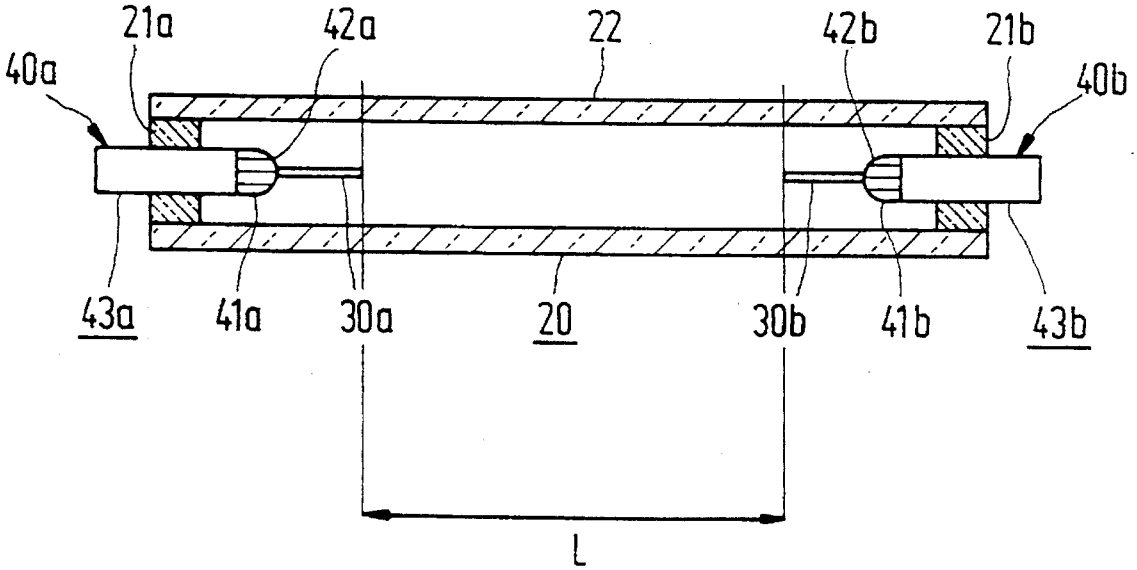
FIG. 2 shows the discharge vessel of the lamp of FIG. 1 in longitudinal section.

FIG. 1 shows a high-pressure sodium lamp provided with an elongate discharge vessel 20 with ends 21*a*, 21*b*. The discharge vessel 20 is circular-cylindrical and has an internal diameter of 0.40 cm. Alternatively, for example, the discharge vessel 20 may narrow towards the ends 21*a*, 21*b*. The discharge vessel 20 made of DCA is enclosed with intervening space 1 by an outer bulb 10 which supports a lamp cap 50. The lamp consumes a power of 150 W during nominal operation. The enclosed space 1 is provided with nitrogen. The filling pressure of the gas in the enclosed space preferably lies between 25 and 100 kPa. The pressure is then high enough on the one hand for considerably improving the heat transport from the discharge vessel to the surroundings, while on the other hand the operating pressure is not so high that special measures, such as a thick wall of the outer bulb, are required for avoiding the risk of explosion. In the present case the filling pressure is 100 kPa. FIG. 2 shows the discharge vessel 20 in which a pair of electrodes 30*a*, 30*b* is arranged, each electrode being fixed with titanium solder 41*a*, 41*b* to an end 42*a*, 42*b* of a lead-through element in the form of a niobium tube 43*a*, 43*b* which serves as a current supply conductor 40*a*, 40*b* and which issues to the exterior at an end 21*a*, 21*b* of the discharge vessel 20. Alternatively, for example, the lead-through element may be a rod. A central portion 22 of the discharge vessel 20 with a length L of 4.2 cm extends up to the electrodes 30*a*, 30*b*. The central portion 22 of the discharge vessel 20 accordingly has a volume V of 0.53 $cm^3$. The discharge vessel 20 is provided with a filling of an amalgam with 0.18 mg sodium and 1.42 mg mercury. The relation $$\frac{m_{Hg}}{\sqrt{V \times L}} = 0.95$$

satisfies the requirement that this ratio must lie between 0.8 and 1.7. More in particular, the ratio lies between 0.9 and 1.4. It is true for the weight ratio of sodium to mercury in the amalgam that:

$$\frac{m_{Na}}{m_{Hg}} = 0.13$$

This ratio, therefore, lies between 0.05 and 0.25, and more in particular between 0.10 and 0.20. 0.8 mg mercury evaporates during operation, which is of the same order of magnitude as the 0.62 mg remaining in the liquid state, while only a small quantity, 0.011 mg, of the sodium present evaporates.

Owing to the said composition, the lamp is highly insensitive to ambient temperature fluctuations.

After an endurance test of 8000 hours, the current supply conductors 40*a*, 40*b* were found to be free from corrosion.

The light radiated by the lamp has a color temperature of approximately 2040 K. The color coordinates (x, y) of the light are 0.525 and 0.417, respectively. The distance to the nearest point (0.524, 0.414) on the Planckjan locus is approximately 0.003, so smaller than 0.01.

The behavior of the lamp was compared with that of a lamp whose discharge vessel was provided with an overdose filling of 25 mg amalgam with a weight ratio of 0.23. The lamp voltages of the lamps were measured during operation while the lamp received/breed cooling from a fan, during operation in neutral surroundings, and during operation with a glass envelope present around the lamp. The lamp voltage measured during this in V is given in the table below. The deviation in percents from the lamp voltage during operation in neutral surroundings is given between parentheses.

| | lamp with overdose fill | lamp according to the invention |
|---|---|---|
| with forced cooling | 92 (−10%) | 101 (−7%) |
| neutral surroundings | 102 (0%) | 109 (0%) |
| with envelope | 120 (+18%) | 115 (+6%) |

In a further embodiment, the lamp consumes a power of 1000 W during operation. The gas filling in the space 1 in the outer bulb 10 of this embodiment preferably has a filling pressure below 90 kPa. Special measures for avoiding the risk of explosion are unnecessary then, also when a comparatively large outer bulb is used. In a practical implementation, the enclosed space has a filling of nitrogen with a filling pressure of 80 kPa. The central portion 22 of the discharge vessel 20 has a length L of 10.8 cm and an internal diameter of 1.09 cm. The volume V of the central portion 22 accordingly is 10.1 $cm^3$. The discharge vessel 20 is provided with a filling comprising 10.64 mg mercury and 1.86 mg sodium. It follows from this that:

$$\frac{m_{Hg}}{\sqrt{V \times L}} = 1.02$$

This satisfies the requirement that the ratio must lie between 0.8 and 1.7. In addition, the ratio lies between the preferred limits of 0.9 and 1.4. The weight ratio of sodium to mercury lies between 0.05 and 0.25, more in particular between 0.10 and 0.20, and is in this case approximately 0.17. During operation 7.0 mg mercury and 0.27 mg sodium evaporate, so that the order of magnitude of the 3.64 mg mercury remaining in the liquid state is comparable to the order of magnitude of the evaporated quantity. Only a small portion of the sodium present has evaporated.

The lamp was subjected to an endurance test of 12,000 hours. A nitride layer had formed on the current supply conductors 40*a*, 40*b* after the endurance test, but no damage had occurred.

Furthermore, unsaturated lamps were manufactured with nitrogen-filled outer bulbs 10. The filling pressure was 65 kPa. The lamps were provided with discharge vessels 20 with an internal diameter of 0.685 cm. The central portion 22 in this case has a length L of 6.6 cm and a volume V of 2.43 $cm^3$. The electrodes 30*a*, 30*b* were fixed to the ends 42*a*, 42*b* of niobium tubes 43*a*, 43*b* with titanium solder joints 41*a*, 41*b*, respectively. The discharge vessel 20 was provided with 2.7 mg mercury and 0.034 mg sodium. It is true for the mercury dose that:

$$\frac{m_{Hg}}{\sqrt{V \times L}} = 0.67$$

The sodium/mercury weight ratio in the amalgam is:

$$\frac{m_{Na}}{m_{Hg}} = 0.013$$

The lamps consumed a power of 400 W during nominal operation. Both the mercury and the sodium were fully evaporated during this. In contrast to the lamps according to the invention, the electrodes 30*a*, 30*b* in several of these lamps had tilted against the discharge vessel 20 within 3000 hours as a result of a corrosive attack on the titanium solder 41*a*, 41*b* by nitrogen, while cracks had appeared in the discharge vessel 20.

We claim:

1. A saturated high-pressure sodium lamp comprising a ceramic discharge vessel which is enclosed with intervening space by an outer bulb, which space is provided with a gas filling, a pair of electrodes arranged in the discharge vessel, a respective current supply conductor connected to each electrode and issuing from the discharge vessel at a respective end, between which electrodes a central portion of the discharge vessel extends with a volume V and a length L, the discharge vessel being provided with a filling of an amalgam with a quantity $m_{Na}$ of sodium by weight and a quantity $m_{Hg}$ of mercury by weight, characterized in that;

the gas in the space in the outer bulb comprises at least 70 mol.% nitrogen, and in that $m_{Hg}$, V and L satisfy the relation $$0.8 \leqq \frac{m_{Hg}}{\sqrt{V \times L}} \leqq 1.7$$

and in that the weight ratio between sodium and mercury in the amalgam satisfies the relation that $$0.05 \leqq \frac{m_{Na}}{m_{Hg}} \leqq 0.25$$

in which $m_g$ and $m_{Na}$ are expressed in mg L in cm and V in $cm^3$, and in that the mercury and sodium are present in a sufficient quantity such that mercury and sodium remain present in the liquid phase during lamp operation throughout lamp life.

2. A high-pressure sodium lamp as claimed in claim 1, characterized in that the weight ratio of sodium to mercury in the amalgam satisfies the relation that $$0.10 \leqq \frac{m_{Na}}{m_{Hg}} \leqq 0.20.$$

3. A saturated high pressure sodium discharge lamp exhibiting unsaturated characteristics, said lamp comprising:

a) an outer envelope sealed in a gas-tight manner;

b) a gas filling within said outer envelope including at least 70 mol.% nitrogen;

c) a discharge device within said outer envelope, said discharge device comprising a ceramic discharge vessel, said discharge vessel including a pair of discharge electrodes between which a discharge is maintained during lamp operation, a pair of current supply conductors each connected to a respective discharge electrode and issuing from the discharge vessel in a gas-tight manner, said discharge vessel including a central portion between said electrodes with a volume V and a length L, and a filling of an amalgam with a quantity of $m_{NA}$ of sodium by weight and a quantity $m_{Hg}$ of mercury by weight, the quantity of mercury and sodium each being selected such that mercury and sodium each remain present in the liquid phase during lamp operation throughout lamp life, $m_{Hg}$, V and L satisfy the relation $$0.8 \leqq \frac{m_{Hg}}{\sqrt{V \times L}} \leqq 1.7$$

and the ratio between sodium and mercury in the amalgam satisfies the relation $$0.05 \leqq \frac{m_{Na}}{m_{Hg}} \leqq 0.25$$

in which $m_{Hg}$ and $m_{NA}$ are expressed in mg, L in cm and V in $cm^{-3}$, whereby said saturated high pressure sodium lamp is highly insensitive to external temperature changes.

4. A saturated high pressure sodium discharge lamp according to claim 3, wherein said current conductors consist essentially of niobium, and said discharge vessel has a temperature during lamp operation at the location where said current conductors extend through said discharge vessel such that, except for a thin nitride layer, corrosion of said current conductors at their portions exposed to said nitrogen-containing gas within said outer envelope substantially does not occur.

* * * * *